US006709544B2

(12) United States Patent
Hu et al.

(10) Patent No.: US 6,709,544 B2
(45) Date of Patent: Mar. 23, 2004

(54) CHEMICAL MECHANICAL POLISHING EQUIPMENT

(75) Inventors: Shao-Chung Hu, Taipei (TW); Chia-Lin Hsu, Taipei (TW); Hsueh-Chung Chen, Taipei Hsien (TW); Shih-Hsun Hsu, Keelung (TW)

(73) Assignee: United Microelectronics Corp., Hsinchu (TW)

( * ) Notice: Subject to any disclaimer, the term of this patent is extended or adjusted under 35 U.S.C. 154(b) by 47 days.

(21) Appl. No.: 10/064,526

(22) Filed: Jul. 24, 2002

(65) Prior Publication Data

US 2004/0016507 A1 Jan. 29, 2004

(51) Int. Cl.[7] ..... B24B 7/00

(52) U.S. Cl. ..... 156/345.12; 156/345.13; 451/66

(58) Field of Search ..... 156/345.12, 345.13; 451/66

(56) References Cited

U.S. PATENT DOCUMENTS 5,688,360 A * 11/1997 Jairath ..... 156/345.12

* cited by examiner

*Primary Examiner*—Gregory Mills
*Assistant Examiner*—Sylvia R. MacArthur
(74) *Attorney, Agent, or Firm*—Jiang Chyun IP Office

(57) ABSTRACT

The present invention related to a CMP equipment, compatible with the existing manufacture processes. The CMP equipment of the present invention employs strip polishing platens that can be smaller than the wafer size, so that the layout is compact and the space is effectively utilized, leading to high throughput and efficient production management. The present invention provides a CMP equipment that offers greater flexibility in performing CMP for different fabrication processes through the choices of various polishing pads and/or polishing slurry.

20 Claims, 5 Drawing Sheets

CHEMICAL MECHANICAL POLISHING EQUIPMENT

BACKGROUND OF INVENTION

1. Field of Invention

The present invention relates to a chemical mechanical polishing equipment. More particularly, the present invention relates to a chemical mechanical polishing equipment with at least one strip platen.

2. Description of Related Art

As semiconductor devices keep scaling down, demand for multiple-level interconnects is getting higher. Multiple-level metallization provides greater flexibility in circuit design and a substantial reduction in die size and chip cost. For integrated circuits, it is common to employ at least two to five metal layers. It is thus very important to have a planarization process on the rough surface of a wafer, so as to facilitate the manufacturing process of the multi-level interconnects and make the transferred wiring patterns more accurate. In addition, the planarization of a wafer is the major factor affecting aligning accuracy in an alignment system. If the planarization process for a wafer is poorly done, not only the mask can not accurately focus on the wafer in the alignment system, but also the error-prone probability during the manufacturing is significantly increased.

Chemical-mechanical polishing (CMP) is regarded as the only technology to provide global planarization in the manufacturing of very-large scale integrated circuits (VLSI), or even ultra-large semiconductor integration (ULSI). Essentially, CMP is based on a principle similar to a "grinding wheel" in mechanical grinding and with the aid of chemical reagents, so that the rough surface of a wafer can then be smoothly ground by using this technology.

FIG. 1 is a schematic view of the conventional CMP equipment. The core elements of the CMP equipment 100 are an automated rotating polishing platen 102 and a wafer holder 104. In general, the polishing platen 102 is designed to be a round platen for the convenience of rotation with a polishing pad 106 arranged on the polishing platen 102. A provided wafer 110 is hold by the wafer holder 104 and position of the wafer holder 104 is adjustable. The wafer holder 104 can both exert force on the wafer 110 and rotate the wafer 110 independent of the rotation of the polishing platen 102. During polishing, the wafer holder 104 ensures the wafer 110 touching the polishing pad 106. A slurry supply 108 is disposed above the polishing platen and provides a polishing slurry 112 for polishing. Polishing of the wafer 110 is accomplished through the polishing pad and the polishing slurry consisting of colloidal silica. The action of polishing is both mechanical and chemical. A conditioner 114 is usually incorporated in the CMP equipment 100 for conditioning the polishing pad.

From the above arrangement shown in FIG. 1, it clearly shows that the size of round polishing platen is required to be bigger than that of the wafer, because other elements, such as, the conditioner and/or the slurry supply, are installed on or above the platen. In other words, the dimension of the CMP equipment is limited by the size of the platen, which is required to be relatively bigger than the size of the wafer. As the size of the wafer keeps increasing, the design of the conventional CMP equipment precludes further scaling down of the equipment.

Furthermore, for a standard fabrication process of forming a copper plug structure, at least two polishing pads with different selectivity are required for polishing the copper layer and the barrier layer, respectively. Therefore, it is inevitable to exchange polishing pads during the CMP process or to transfer the wafer to different polishing platens, which is the bottleneck for increasing throughput and thus leads to inefficient production line management.

SUMMARY OF INVENTION

It is therefore an objective of the present invention to miniaturize and scale down the CMP equipment. The design of the present invention is compatible with the existing manufacture processes. The CMP equipment of the present invention can be scaled down by using strip platens that can be smaller than the wafer size because the size for the polishing platen of the present invention needs not to completely cover the wafer for achieving global planarization. For the CMP equipment of the present invention, the layout is compact and the space is effectively utilized. Therefore, high throughput and efficient production line management can be fulfilled.

The present invention provides a CMP equipment that offers greater flexibility in performing CMP for different fabrication processes through the choices of various polishing pads and/or polishing slurry.

As embodied and broadly described herein, the invention provides a CMP equipment, comprising a wafer holder for holding a provided wafer, at least one strip polishing platen, while the strip polishing platen can be rotated about a rotation axis at the fixed end with a rotating angle less than 360 degrees, a polishing pad arranged on the polishing platen, a robotic arm coupled to the strip polishing platen and a slurry feeding system incorporated in the strip polishing platen to provide a polishing slurry for polishing.

The CMP equipment of the present invention can include one or more wafer holders, according to the requirements of the manufacture processes or other considerations. For each wafer holder of the CMP equipment, one or more strip platens can be used for achieving local planarization or global planarization. The length of the strip platens and the size of the polishing pads can be adjusted for achieving different levels of planarization. In addition, the location of the platens relative to the wafer holder and the position of the polishing pad relative to the wafer holder or relatively within the platen also should be taken into considerations.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

FIG. 2A is a schematic cross-sectional view of a CMP equipment according to one preferred embodiment of this invention, while

DETAILED DESCRIPTION

Figure 1:
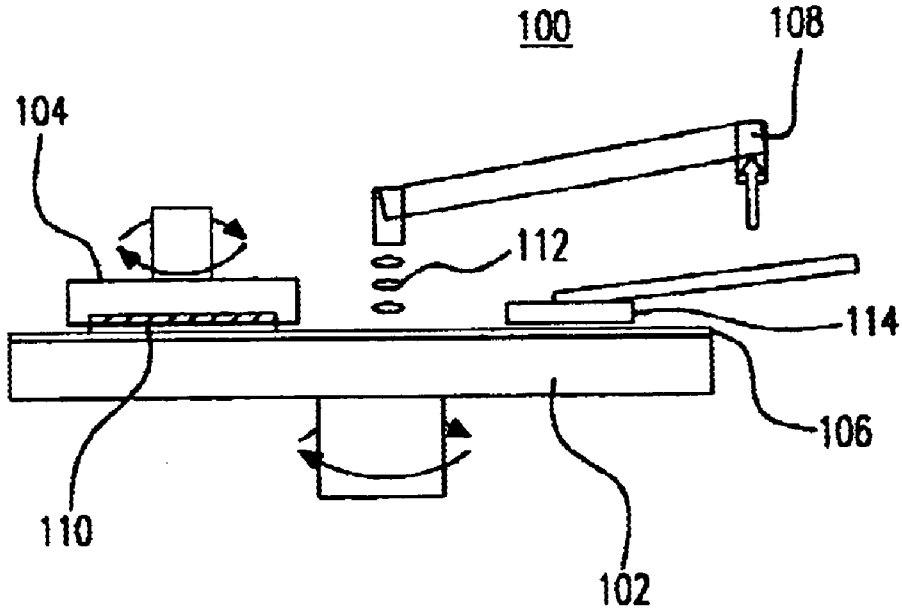
FIG. 1 is a schematic cross-sectional view of the conventional CMP equipment.
Figure 2A:
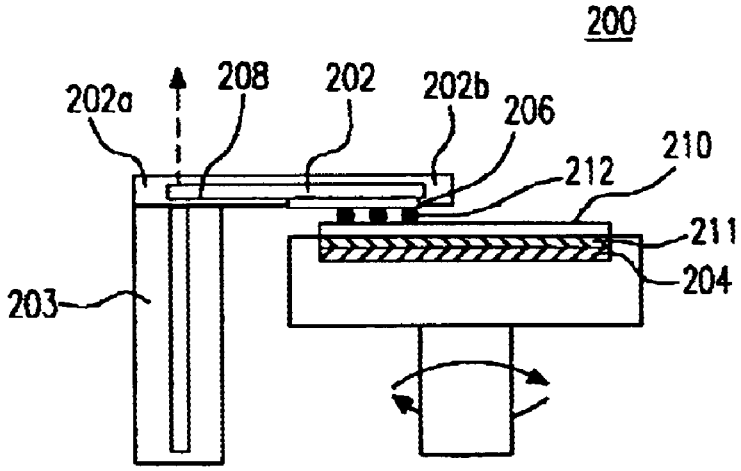
Figure 2B:
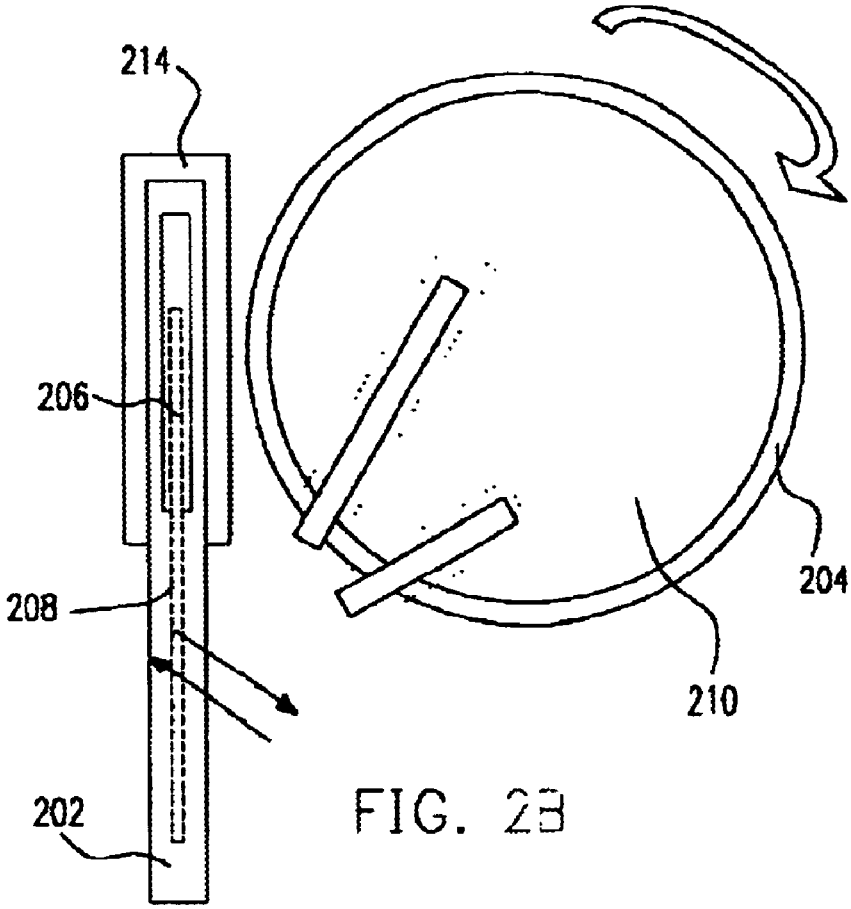
FIG. 2B is a schematic top view of a CMP equipment according to one preferred embodiment of this invention.

The design of the present invention scales down the dimension of the CMP equipment by using strip platens. The strip platen is defined as a polishing platen designed in principle to be a strip shape or a baguette shape. FIGS. 2A–2B illustrate schematically a CMP equipment from cross-sectional view and top view according to one preferred embodiment of this invention. The core elements of the CMP equipment 200 are a strip polishing platen 202 and an automated rotating wafer holder 204. The strip polishing platen 202 is preferably strip-shaped. One end 202*a* of the polishing platen 202 is preferably fixed in a position around the wafer holder 204. The strip platen 202 can be rotated about a rotation axis Z at the fixed end 202*a* of the platen. with a rotating angle less than 360 degrees. Usually, the platen 202 is either seated by the wafer holder 204 during resting or located above the wafer holder during polishing, through the control of a robotic arm 203. A polishing pad 206 is arranged on the polishing platen 202 and, preferably, at the other end 202*b* of the platen. The robotic arm 203 can exert force to ensure the polishing pad 206 of the platen 202 touching a provided wafer 210 during polishing. Moreover, the robotic arm 203 can control the rotation (moving) speed, rotation angle and direction of the platen and the applied pressure of the polishing pad on the wafer.

A slurry feeding system 208 is incorporated in the polishing platen 202 to provide a polishing slurry 212 for polishing. The automatic slurry feeding system 208 is used to ensure proper delivery of the polishing slurry 212 and uniform wetting of the polishing pad 206. Polishing of the wafer 210 is achieved through the help of the polishing pad and the polishing slurry.

The wafer holder 204 holds the wafer 210 and rotates the wafer 210 independent of the rotation of the polishing platen 202. Instead of directly holding the wafer 210, a carrier film 211 is arranged between the wafer 210 and the wafer holder 204 for elasticity.

A conditioner 214 is usually incorporated in the CMP equipment 200 for rejuvenating the surface asperity of the polishing pad 206. The position of the conditioner 214 can be arranged under the resting position of the polishing platen 202. In this case, no extra space is required for installing the conditioner and the polishing platen can be conditioned during resting, if necessary. However, the conditioner can be disposed in any other position depending on the design. In practice, automatic wafer loading system (not shown) and a cassette-to-cassette handler (not shown) are also incorporated in the CMP equipment 200.

The CMP equipment of the present invention can include one or more wafer holders, according to the requirements of the manufacture processes or other considerations. For each wafer holder of the CMP equipment, one or more strip platens can be used for achieving local planarization or global planarization.

Figure 3:
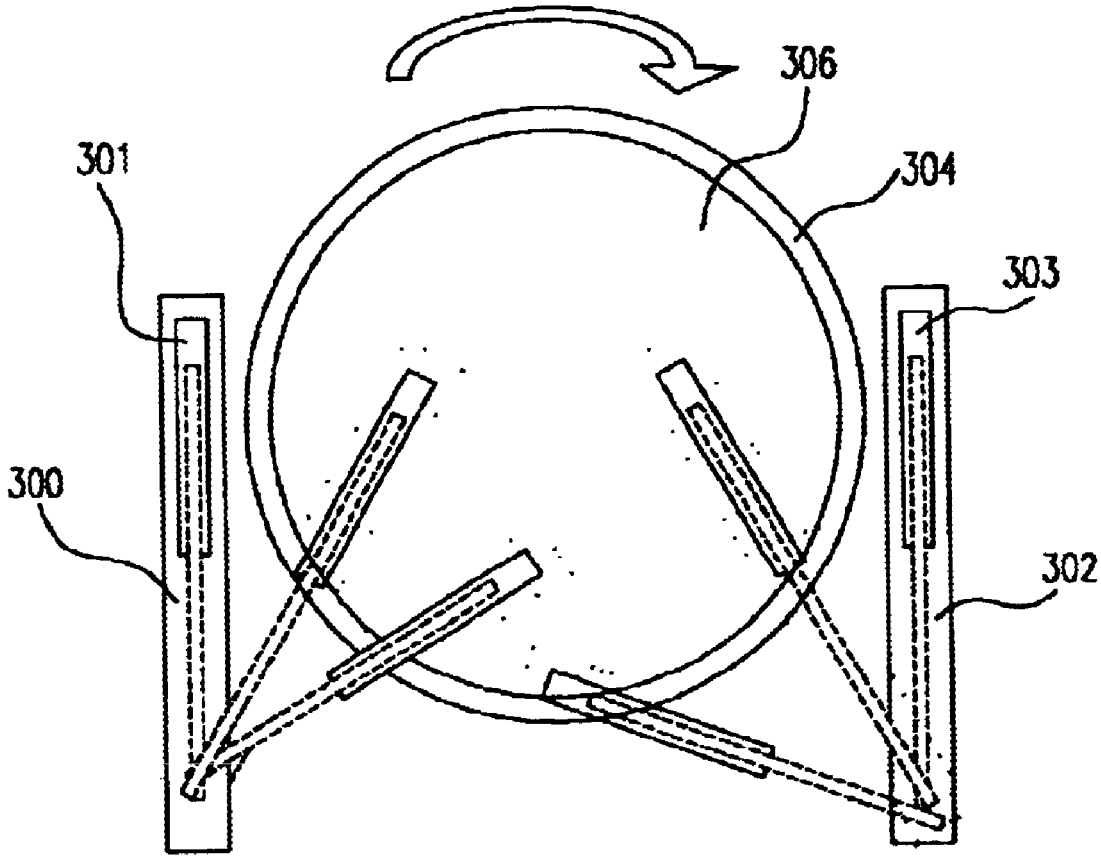
FIG. 3 is a schematic top view of a CMP equipment including two strip platens according to another preferred embodiment of this invention.

As shown in FIG. 3, two strip platens 300, 302 are arranged by opposite sides of the wafer holder 304 and rotate in adverse directions. The strip platens 300, 302 may have the same or different polishing pads and/or different and the same polishing slurry respectively. For example, the polishing platen 300 has a first polishing pad 301 and provides a first slurry, while the polishing platen 302 has a second polishing pad 303 and provides a second slurry. For example, the first polishing pad 301 is a hard pad and the second polishing pad 303 is a soft pad. Hence the combination of the hard pad 301 and the first slurry is responsible for major polishing, whereas and the combination of the soft pad 303 and the second slurry is responsible for minor polishing or buffing. The action of polishing can be performed in sequence, for example, applying the first polishing pad and followed by applying the second polishing pad to the wafer 306. On the other hand, the action of polishing may be performed vice versa.

The length of the strip platens 300, 302 as well as the size of the first and second polishing pads 301, 303 can be adjusted for achieving different levels of planarization. If global planarization is to be accomplished by a single strip platen, the size of the polishing pad on the platen needs to larger or at least equivalent to the radius of the wafer. Careful calculation is required for considering the length of the strip platens and the size of the polishing pads. In addition, the location of the platens relative to the wafer holder and the position of the polishing pad relative to the wafer holder or relatively within the platen also should be taken into considerations.

Figure 4A:
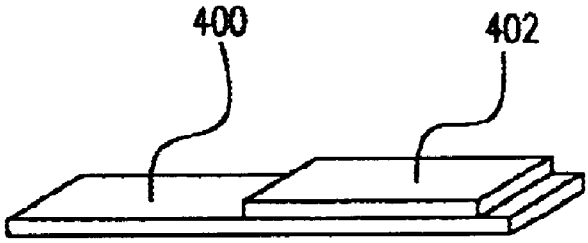
FIG. 4A and FIG. 4B illustrate two different design of a polishing pad according to preferred embodiments of this invention.
Figure 4B:
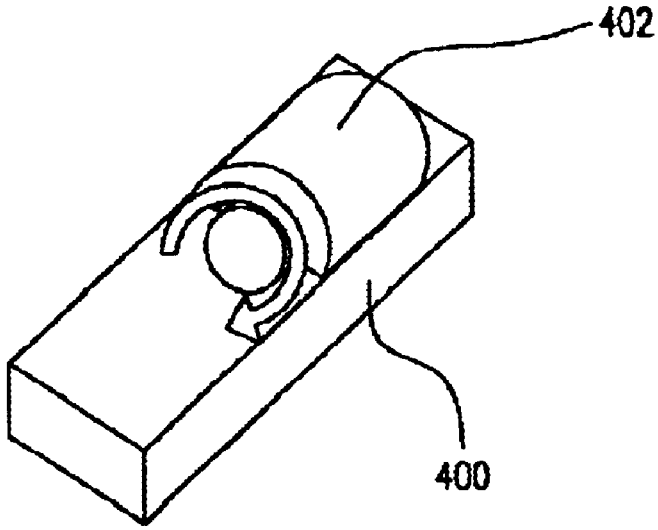

The polishing pad 402 can be a flat pad arranged on the platen 400, as shown in FIG. 4A. However, the design of the polishing pad needs not to be a flat pad, whereas a cylindrical roller (a cylinder) is a possible design for the polishing pad. As shown in FIG. 4B, the polishing pad 402 is a cylindrical polishing roller mounted on the polishing platen 400.

Under these circumstances, the choices of various polishing pads and/or polishing slurry can provide a greater flexibility in performing CMP for different fabrication processes. In a CMP process of the copper plug structure, at least two polishing pads with different selectivity for polishing the copper layer and the barrier layer respectively are required. However, according to the aforementioned design of the preferred embodiment, the patterned wafer hold by the wafer holder can first be polished by the first pad for removing the copper layer and followed by the second pad for removing the barrier layer. There is no need to exchange polishing pads during the CMP process or to transfer the wafer to different polishing platens. Therefore, high throughput and efficient production line management can be achieved through the design of the present invention.

Figure 5:
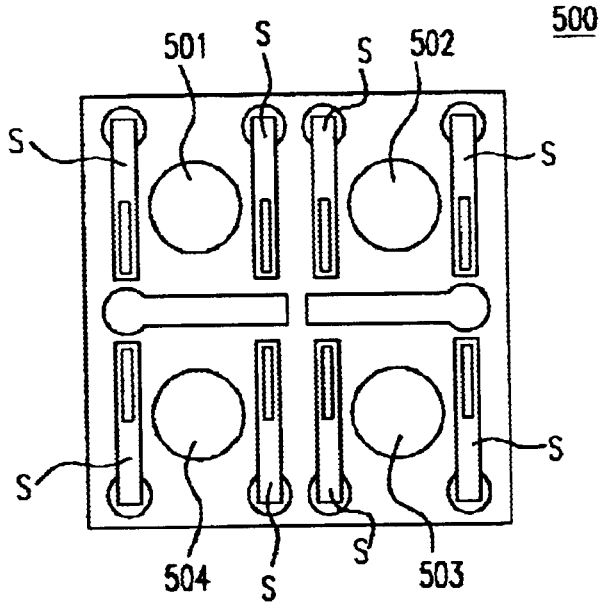
FIG. 5 is a schematic top view of a CMP equipment with fixed wafer holders.
Figure 6:
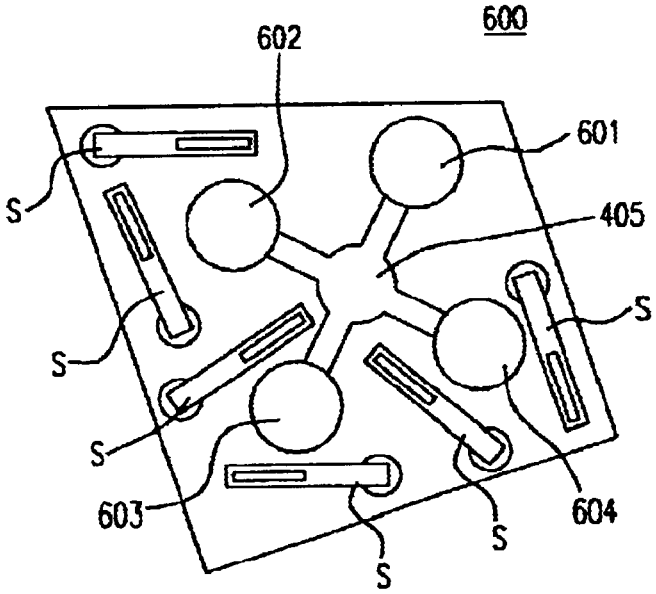
FIG. 6 is a schematic top view of a CMP equipment with inter-switching wafer holders.

As for the CMP equipment including several wafer holders, a plurality of strip platens can be arranged in various styles depending on the requirements of the manufacture processes or other considerations. Two examples are provided and shown in FIG. 5 and FIG. 6. As shown in FIG. 5, a CMP equipment 500 having four fixed wafer holders 501, 502, 503, 504, with a plurality of strip platens S arranged in parallel along the wafer holders. For such design, four wafers can be processed at the same time or the wafers can be transferred to one another wafer holder with the help of an auxiliary transfer mechanism (not shown). FIG. 6 illustrates a CMP equipment 600 with four wafer holders 601, 602. 603, 604, while a plurality of strip platens S are arranged along the wafer holders. Except for rotation of these wafer holders themselves, these four wafer holders can inter-switch in either clockwise or anti-clockwise direction through a central rotating swivel 405 to transfer wafers (not shown) for different platens. This design is common is performing sequential CMP processes, for example. The arrangement of the strip platens S has been shown to be versatile, as long as the strip platens do not hit one another.

As the size of the wafer keeps increasing, the design of the conventional CMP equipment precludes further scaling down of the CMP equipment. However, the dimension for the CMP equipment of the present invention does not have to be not limited by the size of the platen. According to the aforementioned design, it clearly shows that the size for the polishing platen of the present invention needs not to completely cover the wafer for achieving global planarization. Therefore, the CMP equipment can be scaled down by using the strip platens that can be smaller than the wafer size. Furthermore, other elements, such as, the conditioner and the slurry feeding system, are either arranged under the resting position of the platen or incorporated within the platen, so that the layout is compact and the space is effectively utilized.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chemical mechanical polishing (CMP) equipment, comprising:

a wafer holder for holding a provided wafer;

at least one strip polishing platen, wherein one end of the strip polishing platen is fixed and the strip polishing platen can be rotated about a rotation axis at the fixed end with a rotating angle less than 360 degrees;

a polishing pad arranged on the polishing platen;

a robotic arm coupled to the strip polishing platen, wherein the robotic arm controls a rotation of the strip polishing platen and ensures the polishing pad on the strip polishing platen touching the provided wafer during polishing; and a slurry feeding system incorporated in the strip polishing platen to provide a polishing slurry between the polishing pad and the wafer for polishing, wherein the strip polishing platen is located above the wafer holder during polishing and the polishing pad on the strip polishing platen faces the wafer holder, while the wafer holder rotates the wafer independent of the rotation of the strip polishing platen, and wherein the strip polishing platen is seated in a resting position beside the wafer holder during resting.

2. The CMP equipment of claim 1, wherein the strip polishing platen is strip-shaped.

3. The CMP equipment of claim 1, wherein the strip polishing platen is baguette-shaped.

4. The CMP equipment of claim 1, wherein the robotic arm further controls an applied pressure of the polishing pad on the wafer.

5. The CMP equipment of claim 1, wherein the strip polishing platen rotates with the rotating angle from 0 to 90 degrees.

6. The CMP equipment of claim 1, wherein the polishing pad is arranged on the polishing platen at an end opposite to the fixed end of the strip polishing platen.

7. The CMP equipment of claim 1, wherein a carrier film is further included between the wafer and the wafer holder for elasticity.

8. The CMP equipment of claim 1, wherein a conditioner is further included and arranged under the polishing platen and at the resting position of the polishing platen.

9. The CMP equipment of claim 1, wherein the polishing pad is a flat pad arranged on the strip polishing platen.

10. The CMP equipment of claim 1, wherein the polishing pad is a cylindrical polishing roller mounted on the strip polishing platen.

11. A chemical mechanical polishing (CMP) equipment, comprising:

a plurality of wafer holders for holding a wafer;

a plurality of strip polishing platens arranged aside of the wafer holders, each strip polishing platen, comprising a polishing pad arranged on the polishing platen;

a robotic arm coupled to the strip polishing platen, wherein the robotic arm controls a rotation of the strip polishing platen and ensures the polishing pad on the strip polishing platen touching the wafer during polishing; and a slurry feeding system incorporated in the strip polishing platen to provide a polishing slurry between the polishing pad and the wafer for polishing, wherein one end of the strip polishing platen is fixed and the strip polishing platen can be rotated about a rotation axis at the fixed end with a rotating angle less than 360 degrees, wherein the strip polishing platen is located above one wafer holder during polishing and the polishing pad on the strip polishing platen faces the wafer holder, while the wafer holder rotates the wafer independent of the rotation of the strip polishing platen, and wherein the strip polishing platen is seated in a resting position beside the wafer holder during resting.

12. The CMP equipment of claim 11, wherein each strip polishing platen is strip-shaped.

13. The CMP equipment of claim 11, wherein each strip polishing platen is baguette-shaped.

14. The CMP equipment of claim 11, wherein the robotic arm further controls an applied pressure of the polishing pad on the wafer.

15. The CMP equipment of claim 11, wherein each strip polishing platen rotates with the rotating angle from 0 to 90 degrees.

16. The CMP equipment of claim 11, wherein the polishing pad is arranged on the polishing platen at an end opposite to the fixed end of the strip polishing platen.

17. The CMP equipment of claim 11, wherein a carrier film is further included between the wafer and each wafer holder for elasticity.

18. The CMP equipment of claim 11, wherein a conditioner is further included and arranged under the polishing platen and at the resting position of the polishing platen.

19. The CMP equipment of claim 11, wherein the polishing pad is a flat pad arranged on the strip polishing platen.

20. The CMP equipment of claim 11, wherein the polishing pad is a cylindrical polishing roller mounted on the strip polishing platen.

* * * * *